US010297961B2

(12) United States Patent
Takahashi

(10) Patent No.: US 10,297,961 B2
(45) Date of Patent: May 21, 2019

(54) COAXIAL CABLE CONNECTOR AND COAXIAL CONNECTOR DEVICE

(71) Applicant: HIROSE ELECTRIC CO., LTD., Tokyo (JP)

(72) Inventor: Keisuke Takahashi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/057,342

(22) Filed: Aug. 7, 2018

(65) Prior Publication Data

US 2019/0052031 A1 Feb. 14, 2019

(30) Foreign Application Priority Data

Aug. 10, 2017 (JP) ..... 2017-155754

(51) Int. Cl.

*H01R 27/00* (2006.01)
*H01R 24/56* (2011.01)
*H01R 13/504* (2006.01)
*H01R 24/42* (2011.01)

(52) U.S. Cl.

CPC ..... *H01R 24/56* (2013.01); *H01R 13/504* (2013.01); *H01R 24/42* (2013.01); *H01R 2201/20* (2013.01)

(58) Field of Classification Search

CPC ..... H01R 24/56; H01R 24/42; H01R 13/504; H01R 2201/20
USPC ..... 439/218, 219, 578, 675, 912
See application file for complete search history.

(56) References Cited

U.S. PATENT DOCUMENTS 6,572,407 B1 * 6/2003 Ko ..... H01R 9/0518 439/582
8,251,762 B2 * 8/2012 Maier ..... H01R 13/64 439/521
8,475,206 B2 * 7/2013 Kubo ..... H01R 9/0518 439/582
8,636,542 B2 1/2014 Funahashi
2012/0295477 A1 11/2012 Funahashi

FOREIGN PATENT DOCUMENTS

JP 5757153 7/2015

* cited by examiner

*Primary Examiner* — Khiem M Nguyen
(74) *Attorney, Agent, or Firm* — Rankin, Hill & Clark LLP

(57) ABSTRACT

A coaxial cable connector includes a signal terminal and a housing, wherein the signal terminal includes a terminal contact portion for contacting a signal terminal of a counterpart connector, a conductor connection portion for connection with a central conductor of a coaxial cable, a wide portion between the terminal contact portion and the conductor connection portion, a first link portion linking the conductor connection portion and the wide portion, and a second link portion linking the terminal contact portion and the wide portion, wherein the wide portion has a width greater than a width of the first link portion and the second link portion which are adjacent to the wide portion, and the housing includes a mount portion in which the terminal contact portion is mounted, a fixing portion for fixing the central conductor to the conductor connection portion, and a window disposed between the mount portion and the fixing portion to enable external access to the wide portion.

8 Claims, 4 Drawing Sheets

COAXIAL CABLE CONNECTOR AND COAXIAL CONNECTOR DEVICE

CROSS-REFERENCE TO RELATED APPLICATION

This application claims priority from Japanese Patent Application No. 2017-155754 filed with the Japan Patent Office on Aug. 10, 2017, the entire content of which is hereby incorporated by reference.

BACKGROUND

1. Technical Field

The present disclosure relates to a coaxial cable connector and a coaxial connector device,

2. Related Art

A coaxial cable connector mainly includes a signal terminal, a housing supporting the signal terminal, and a shell covering the outer portion of the housing. When a coaxial cable is attached to the coaxial cable connector, the signal terminal is connected to the central conductor of the coaxial cable. The status of conduction between the signal terminal and the central conductor can be tested by pressing a testing probe onto the signal terminal.

The conduction test is generally performed by pressing the testing probe onto a part of the signal terminal, particularly a terminal contact portion contacting a counterpart connector. However, when the testing probe is pressed onto the terminal contact portion, the terminal contact portion may buckle, or the contact force of the terminal contact portion may be decreased due to the pressing of the testing probe, for example. In addition, contact failure may be caused.

SUMMARY

A coaxial cable connector according to the embodiment includes a signal terminal, a housing integrally formed with the signal terminal, and a shell attached to the housing, wherein the signal terminal includes a terminal contact portion for contacting a mating signal terminal of a counterpart connector, a conductor connection portion for connection with a central conductor of a coaxial cable, a wide portion disposed between the terminal contact portion and the conductor connection portion, a first link portion linking the conductor connection portion and the wide portion, and a second link portion linking the terminal contact portion and the wide portion, wherein the wide portion has a width, in a width direction orthogonal to an axial direction of the coaxial cable, greater than a width of at least parts of the first link portion and the second link portion which are adjacent to the wide portion in the axial direction of the coaxial cable, and the housing is disposed on a surface of the shell which is positioned in a portion for mating with the counterpart connector, and includes a mount portion in which the terminal contact portion is mounted, a fixing portion for fixing the central conductor of the coaxial cable with respect to the conductor connection portion, and a window disposed between the mount portion and the fixing portion to enable external access to the wide portion.

DETAILED DESCRIPTION

Figure 1:
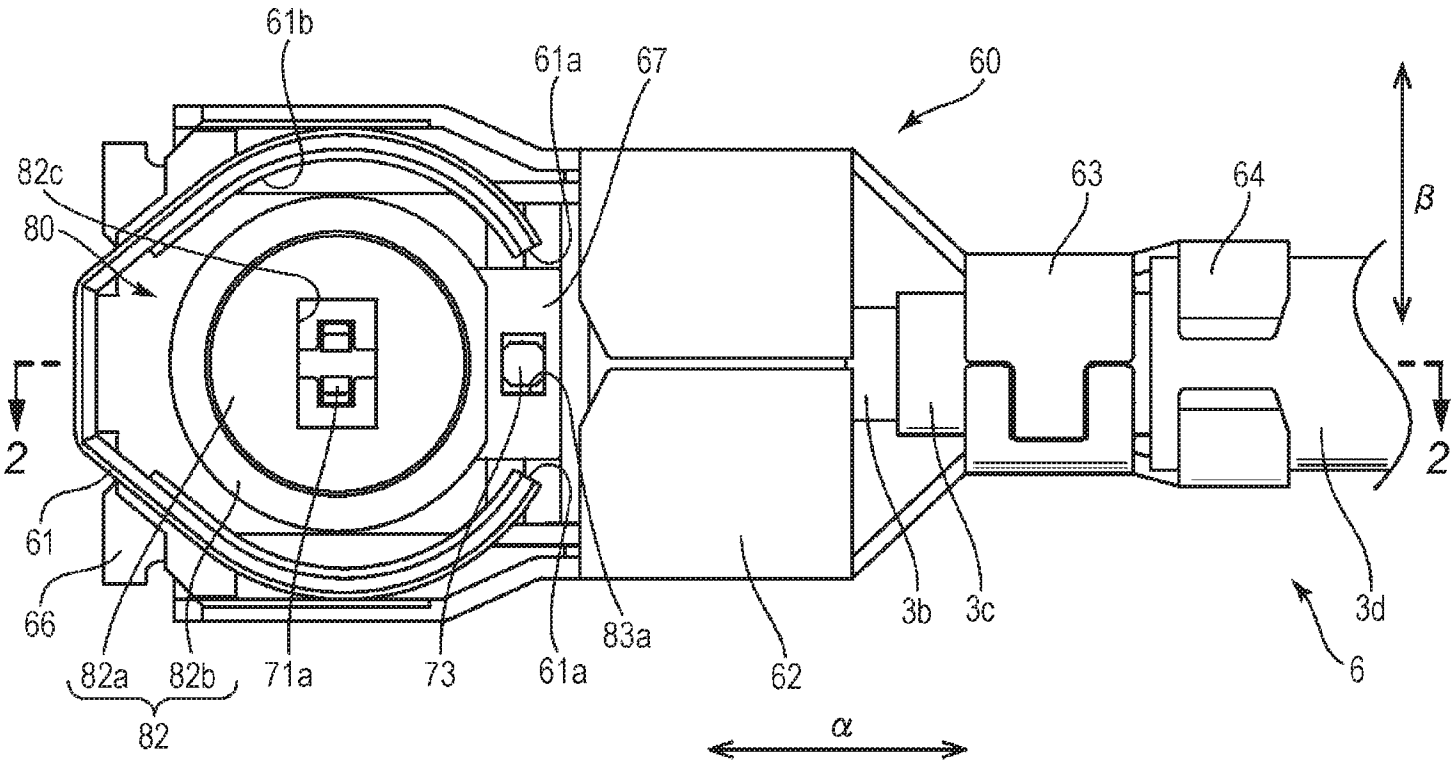
FIG. 1 is a plan view from the bottom side of a coaxial cable connector according to an embodiment of the present disclosure to which one end of a coaxial cable is connected.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In order to perform a conduction test without bringing the testing probe into contact with the terminal contact portion, it may be preferable to bring the testing probe into contact with a part of the signal terminal other than the terminal contact portion. However, parts of the signal terminal other than the terminal contact portion are generally covered with a housing or a shell that covers the outer portion of the housing. Accordingly, it is difficult to access a part of the signal terminal other than the terminal contact portion.

The present disclosure addresses the problem of the related art. Specifically, an object of the present disclosure is to provide a coaxial cable connector with which a conduction test can be performed easily and reliably using a testing probe without bringing the testing probe into contact with the terminal contact portion. Another object of the present disclosure is to provide a coaxial connector device in which the coaxial cable connector is utilized.

Japanese Patent No. 5757153 discloses a coaxial cable connector provided with a through-opening. The through-opening, however, is provided not for performing a conduction test using a testing probe, but for visually confirming the connection state between the central conductor of a coaxial cable and a central conductor connection portion of a contact member. More specifically, in the connector according to Japanese Patent No. 5757153, a through-opening is merely formed in a part of an insulating housing member, and another through-opening is merely formed in a part of the contact member. These openings, however, are merely for enabling visual inspection, and are not formed for the purpose of a conduction test by means of a testing probe. Accordingly, the through-openings are not suitable for the conduction test, and are unrelated to the contact of a testing probe to which the present disclosure is directed.

In order to solve the above problem, a coaxial cable connector according to one aspect of the present disclosure includes a signal terminal, a housing integrally formed with the signal terminal, and a shell attached to the housing, wherein the signal terminal includes a terminal contact portion for contacting a mating signal terminal of a counterpart connector, a conductor connection portion for connection with a central conductor of a coaxial cable, a wide portion disposed between the terminal contact portion and the conductor connection portion, a first link portion linking the conductor connection portion and the wide portion, and a second link portion linking the terminal contact portion and the wide portion, wherein the wide portion has a width, in a width direction orthogonal to an axial direction of the coaxial cable, greater than a width of at least parts of the first link portion and the second link portion which are adjacent to the wide portion in the axial direction of the coaxial cable, and the housing is disposed on a surface of the shell which is positioned in a portion for mating with the counterpart connector, and includes a mount portion in which the terminal contact portion is mounted, a fixing portion for fixing the central conductor of the coaxial cable with respect to the conductor connection portion, and a window disposed between the mount portion and the fixing portion to enable external access to the wide portion.

According to the coaxial cable connector of the above embodiment, the wide portion makes it possible to press the testing probe onto the signal terminal more reliably. Further, the strength of the signal terminal can be increased. In addition, the signal terminal can be fixed to the housing more reliably. Further, due to a synergistic effect of the window and the wide portion, variations in impedance can be suppressed. Furthermore, the height of the coaxial cable connector can be reduced due to the configuration in which the housing 80 is disposed in the surface 66*a* positioned in the portion of the shell 60 for mating with the counterpart connector.

In the coaxial cable connector according to the embodiment, preferably, the wide portion and the window may be aligned in the direction for mating with the counterpart connector.

Alignment in such direction facilitates the insertion of the testing probe.

In the coaxial cable connector according to the above embodiment, the signal terminal may preferably extend in the axial direction.

In this configuration, the wide portion can provide resistive force even when the signal terminal is subjected to a force in the axial direction.

In the coaxial cable connector according to the embodiment, preferably the conductor connection portion has a width greater than a width of the second link portion.

Thus, when the conductor connection portion has an increased width, the area connectable with the central conductor of the coaxial cable is increased. Accordingly, the central conductor can be connected to the terminal contact portion more reliably. In addition, the strength of the signal terminal is increased.

In the coaxial cable connector of the embodiment, a part of the mount portion may be formed as a substantially cylindrical portion, and at least a part of the substantially cylindrical portion, when mated with the counterpart connector, may be internally fitted in a recess provided in a mating housing of the counterpart connector.

In this configuration, a part of the housing cap be utilized for mating.

In the coaxial cable connector according to the embodiment, the window may preferably be disposed in a central portion of the housing provided between the substantially cylindrical portion and the fixing portion.

In the coaxial cable connector according to the embodiment, the shell may include a substantially annular mating portion which is loosely fitted with respect to an outer periphery of the substantially cylindrical portion, and the window may be positioned in a cut-out provided in the substantially annular mating portion.

The substantially annular mating portion only needs to be configured to mate with the mating shell of the counterpart connector. Accordingly, the substantially annular mating portion can be provided with a cut-out portion. By providing the window in a specific position of the housing so that the window is disposed in the cut-out portion, it becomes possible to position the wide portion in a position properly spaced apart from both the terminal contact portion and the conductor connection portion of the signal terminal, without increasing the size of the coaxial cable connector in the axial direction.

According to the present embodiment, there is provided a coaxial cable connector with which a conduction test using a testing probe can be performed easily and reliably without bringing the testing probe into contact with the terminal contact portion. There is also provided a coaxial connector device in which the coaxial cable connector is utilized.

In the following, a preferred embodiment of the present disclosure will be described with reference to the attached drawings. It should be noted that the preferred embodiment is set forth for the convenience of description, and is not intended to limit the present disclosure to the preferred embodiment.

Figure 2:
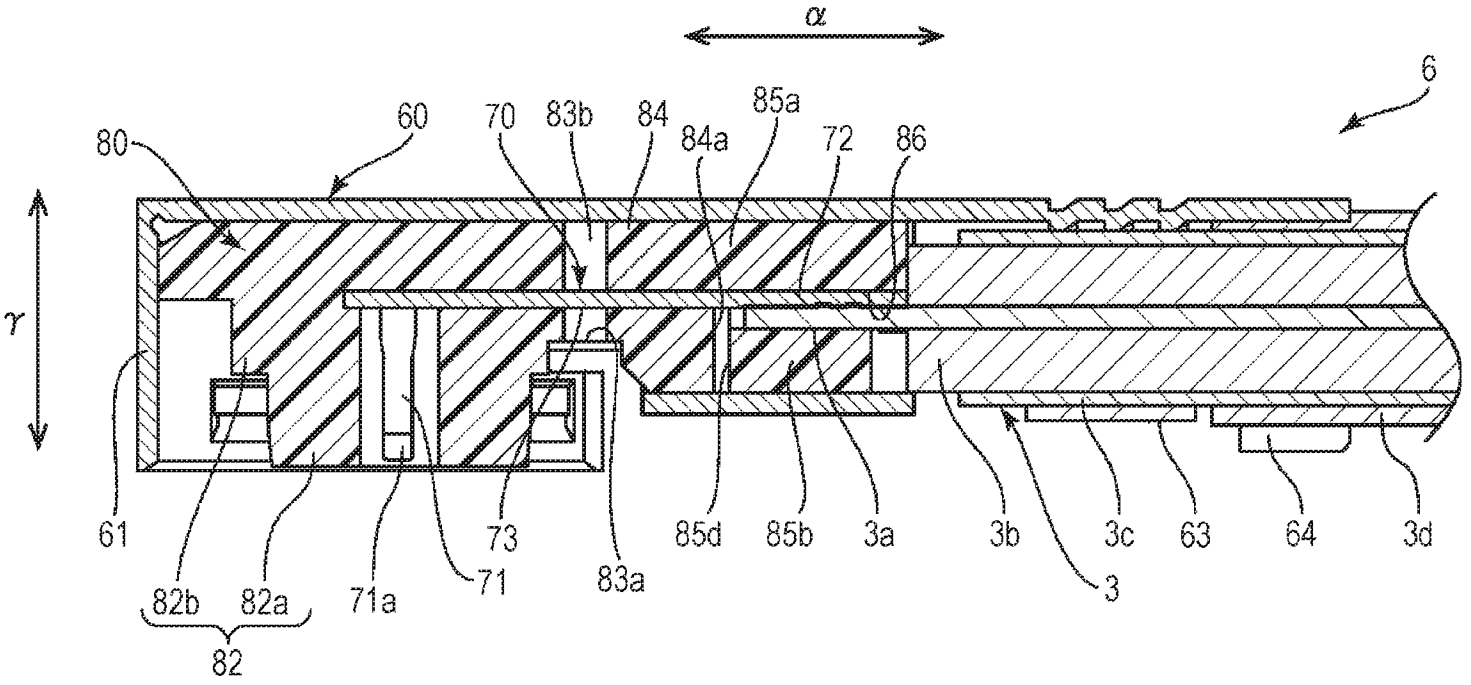
FIG. 2 is a cross sectional view taken along line 2-2 of FIG. 1.
Figure 3:
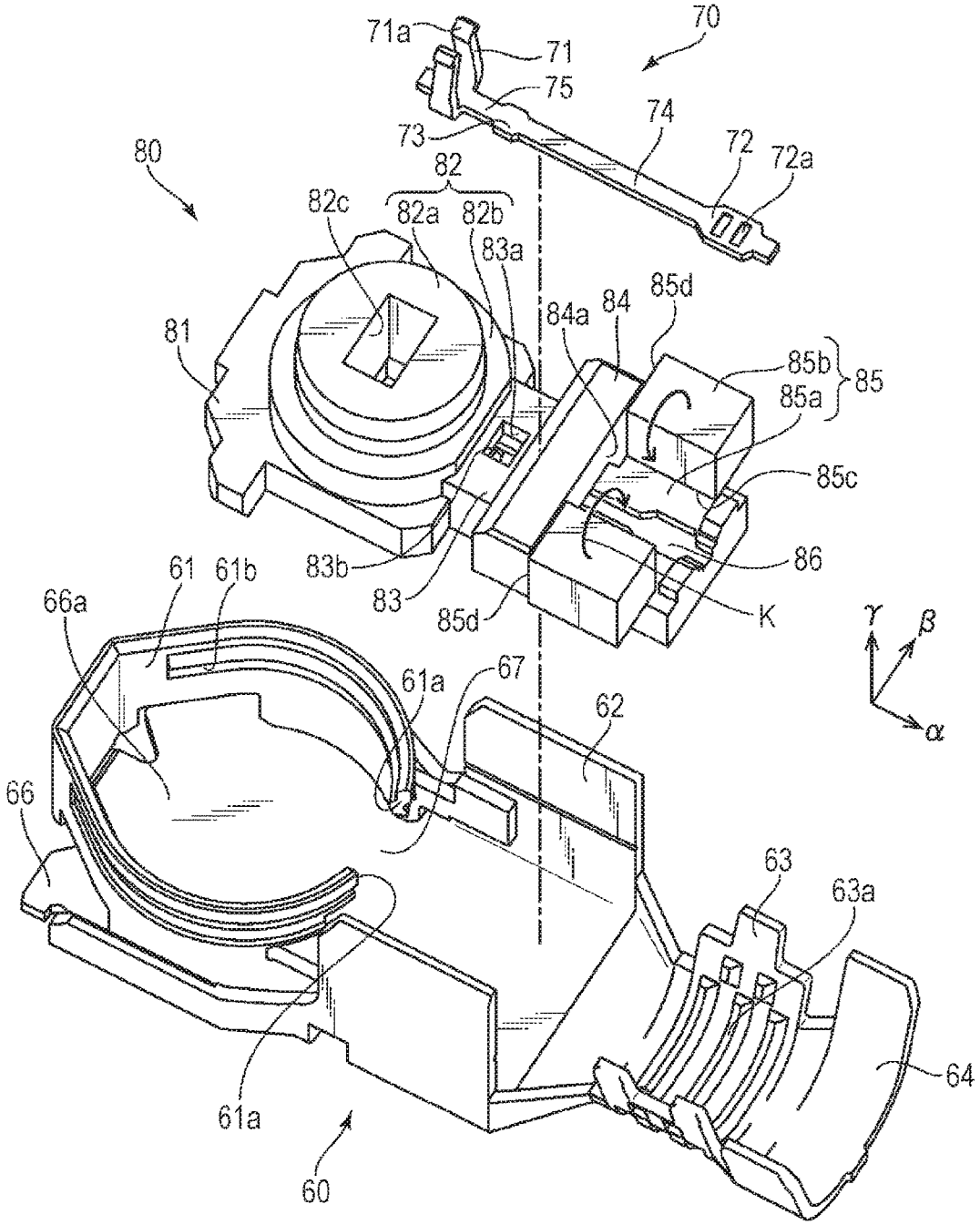
FIG. 3 is an exploded perspective view of the coaxial cable connector.

FIG. 1 is a plan view from the bottom side of a coaxial cable connector 6 according to an embodiment of the present disclosure to which one end of a coaxial cable 3 is connected. FIG. 2 is a cross sectional view taken along line 2-2 of FIG. 1. FIG. 3 is an exploded perspective view of the coaxial cable connector 6.

The coaxial cable connector 6 extends in an axial direction ("a" direction indicated by arrows) of the coaxial cable 3. The coaxial cable 3 includes a central conductor 3*a*, an insulator 3*b* that covers the central conductor 3*a*, an outer conductor 3*c* that covers the insulator 3*b*, and an outer-most outer coating 3*d*. Though not illustrated, the coaxial cable connector 6 may be combined with a counterpart connector to configure a coaxial connector device.

Figure 4:
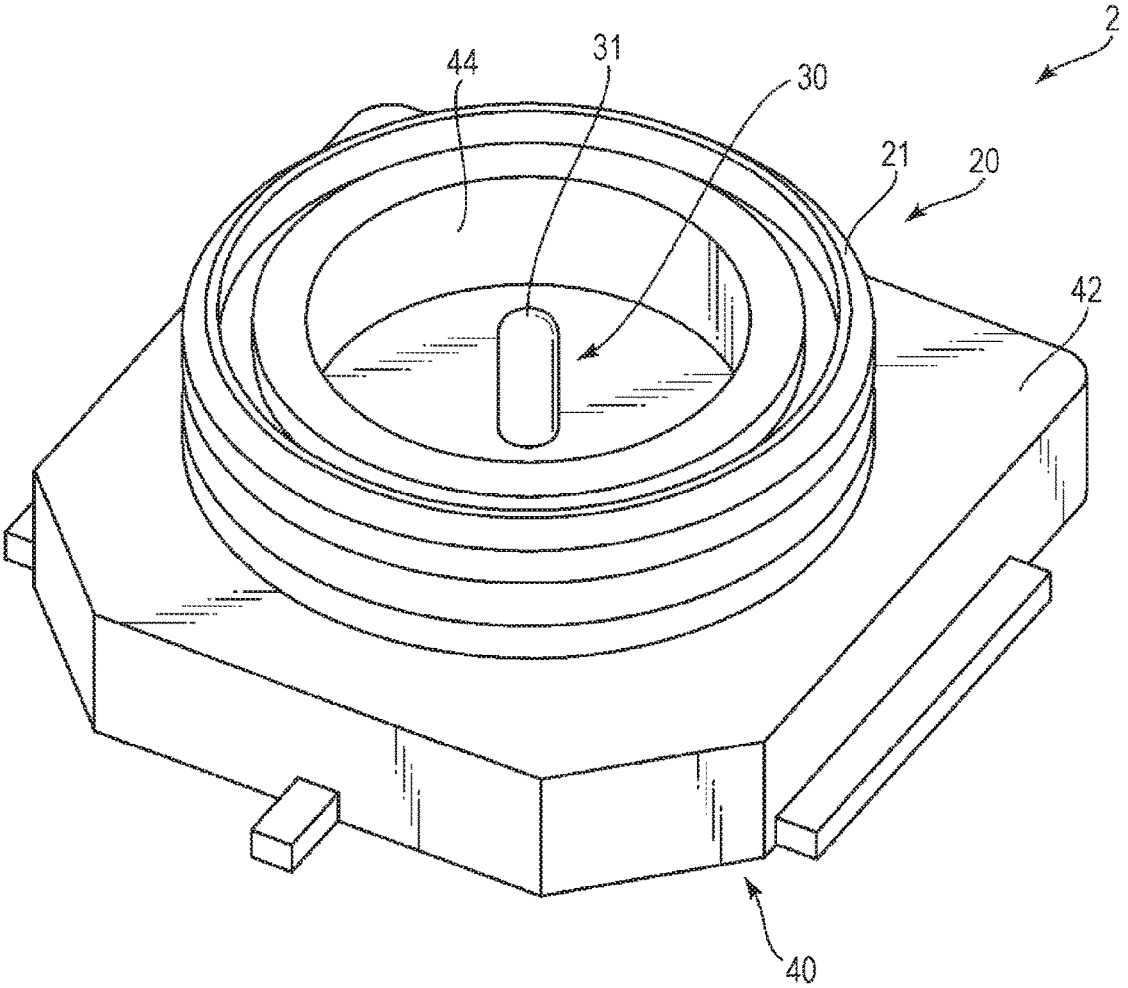
FIG. 4 is a diagram illustrating an example of a counterpart connector.

FIG. 4 illustrates an example of the counterpart connector. The example is a surface mount-type coaxial connector 2 to be mounted on a substrate. FIG. 4 is a perspective view of the coaxial connector 2. The coaxial connector 2 mainly includes a signal terminal 30, a metal shell 20, and a resin housing 40 integrally formed with the signal terminal 30 and the shell 20.

The coaxial cable connector 6 includes a signal terminal 70, a resin housing 80 integrally formed with the signal terminal 70, and a metal shell 60 installed to cover the outside of the housing 80. One end of the coaxial cable 3 (front end) is connected to the rear end side of the coaxial cable connector 6. When connecting with the counterpart connector 2, the coaxial cable connector 6 can be mated and connected with the counterpart connector 2 in the direction "γ" indicated by arrow, via a substantially cylindrical portion 82 of the housing 80 and a substantially tubular mating portion 61 of the shell 60 which are disposed on a distal end side of the coaxial cable connector 6.

The signal terminal 70 extends in the axial direction "α". The signal terminal 70 includes, in this order, a terminal contact portion 71, a wide portion 73, and a conductor connection portion 72.

The terminal contact portion 71 extends in the direction "γ", which is a mating direction orthogonal to the axial direction "α", toward the side for mating with the counterpart connector 2. The terminal contact portion 71 is configured to contact the mating signal terminal 30 of the counterpart connector 2 when the counterpart connector 2 is connected with the coaxial cable connector 6. At the distal end of the terminal contact portion 71, a pair of contacts 71*a* is formed. The pair of contacts 71*a* is configured to he able to sandwich the contact portion 31 of the mating signal terminal 30.

The conductor connection portion 72 is connected with the central conductor 3*a* of the coaxial cable 3 when the counterpart connector 2 is connected to the coaxial cable connector 6. The width of the conductor connection portion 72 in a width direction "β" orthogonal to both the axial direction "α" and the mating direction "γ" is greater than the width of a first link portion 74 connecting the conductor connection portion 72 and the wide portion 73. The increased width of the conductor connection portion 72 results in an increase in the area connectable with the central conductor of the coaxial cable. Thus, the central conductor can be connected with the conductor connection portion 72 more reliably. In addition, the strength of the signal terminal is increased. The conductor connection portion 72 may preferably include fixing ribs 72*a* in a surface thereof. The fixing ribs 72*a* increase the friction with respect to the central conductor 3*a*, allowing the central conductor 3*a* to be held more reliably.

The wide portion 73 is disposed between the terminal contact portion 71 and the conductor connection portion 72, such as in a substantially central position therebetween. During a conduction test, a testing probe can be pressed onto the wide portion 73. The width of the wide portion 73 in the width direction "β" is greater than the width of the first link portion 74 linking the conductor connection portion 72 and the wide portion 73, and the width of the second link portion 75 linking the terminal contact portion 71 and the wide portion 73, for example. The first link portion 74 and the second link portion 75, which are illustrated in FIG. 3 as having the same width in the axial direction "α", may not have the same width. More specifically, the wide portion 73 only needs to have an increased width compared with at least the widths of the portions of the first link portion 74 and the second link portion 75 that are adjacent to the wide portion 73 in the axial direction "α". The adjacent portions are entirely covered with the resin of the housing 80. More specifically, the wide portion 73 only needs to have an increased width compared with the widths of the portions of the first link portion 74 and the second link portion 75 that are exposed from the housing 80. By means of the wide portion 73, the area onto which the testing probe can be pressed is increased. In addition, the testing probe can be pressed onto the signal terminal more reliably. In this case, it is not necessary to press the testing probe strongly. Accordingly, the likelihood of the wide portion 73 being damaged or scratched by the testing probe is reduced. Further, in the present configuration, the testing probe is not contacted with the terminal contact portion 71. Accordingly, the breaking of the terminal contact portion 71 is barely unlikely. This means that it is not necessary to reduce the diameter of the testing probe. With regard to the testing probe, the shape and size (particularly the diameter) can be relatively freely determined, as long as the strength of the testing probe can be maintained. In addition, the strength of the signal terminal 70 can be increased. Further, the signal terminal 70 can be fixed to the housing 80 more reliably, The housing 80 includes, in this order in the axial direction "α", a mount portion (81, 82), a neck portion 83, a front-side body 84, and a rear-side body 85.

In the mount portion (81, 82), the terminal contact portion 71 of the signal terminal 70 is mounted. The mount portion includes a flat base 81 which is rectangular in plan view, and a substantially cylindrical portion 82 formed on the surface of the flat base 81 on the side for mating with the counterpart connector 2. The substantially cylindrical portion 82 is formed in a stepped manner. The substantially cylindrical portion 82 includes a small-diameter cylindrical portion 82*a* disposed on the side for mating with the counterpart connector, and a large-diameter cylindrical portion 82*b* spaced apart from the side for mating with the counterpart connector 2. The small-diameter cylindrical portion 82*a* is internally fitted in a recess 44 provided in a mating housing 40 of the counterpart connector 2 when the counterpart connector 2 is connected with the coaxial cable connector 6. The cylindrical portions 82*a*, 82*b* have a terminal hole 82*c* for exposing the terminal contact portion 71, the terminal hole 82*c* extending in the direction "γ" for mating with the counterpart connector 2.

The neck portion 83 is a central portion positioned between a body including the front-side body 84 and the rear-side body 85, and the mount portion including the flat base 81 and the substantially cylindrical portion 82. The length of the neck portion 83 in the width direction "β" is smaller than the corresponding lengths of the front-side body 84 and the flat base 81. The wide portion 73 of the signal terminal 70 is positioned in the neck portion 83. Further, the neck portion 83 is provided with a window 83*a* for allowing external access to the wide portion 73. The window 83*a* is aligned with the wide portion 73 in the direction "γ" for mating with the counterpart connector 2. In the neck portion 83, the thickness of the housing 80 in the direction "γ" for mating with the counterpart connector 2 is decreased, compared with the mount portion (81, 82) and the body (84, 85). Accordingly, by aligning the wide portion 73 and the window 83*a* with the neck portion 83, their fabrication becomes easier.

Figure 5:
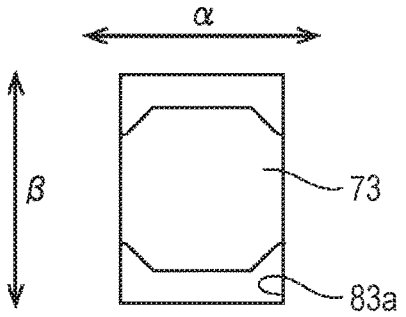
FIG. 5 is a partial enlargement view illustrating the relationship between a window and a wide portion.

FIG. 5 is a partial enlargement view illustrating the relationship between the window 83*a* and the wide portion 73. As illustrated, the wide portion 73 is substantially entirely exposed via the window 83*a*. As is well known, the relative permittivity of air and the relative permittivity of the resin from which the housing 80 is formed are different. Generally, the relative permittivity of air is greater than that of resins. Accordingly, the impedance of the signal terminal 70 may be increased due to the window 83*a*. In addition, signal characteristics may be greatly changed, for example, depending on the distance between the shell 60 and the signal terminal 70, and the relative permittivity of the material interposed therebetween. In the present configuration, however, the impedance of the signal terminal 70 is reduced by means of the wide portion 73. Thus, the variation in impedance can be suppressed by the synergistic, or cancelling, effect of the window 83*a* and the wide portion 73. Accordingly, in the present configuration, it becomes possible, due to the window 83*a* and the wide portion 73, to perform a signal terminal test reliably. In addition, the signal characteristics can also be improved by the synergistic effect of the window 83*a* and the wide portion 73. The actual size of the window 83*a* and the size of the wide portion 73 corresponding to the size of the window 83*a* can be easily set by simulation. Preferably, the window 83*a* has a size such that the wide portion 73 can be substantially entirely exposed.

The rear-side body 85 functions as a fixing portion for fixing the central conductor 3*a* of the coaxial cable 3 with respect to the conductor connection portion 72 of the signal terminal 70. The rear-side body 85 includes a pair of crimping portions 85*b*. The crimping portions 85*b* can be configured to rotate toward a bottom portion 85*a* in a "K" direction indicated by arrow, about a folding portion 85*c*, as a center, which is formed in thin sheet shape so as to be foldable. The bottom portion 85*a* includes a recess 86 for positioning the conductor connection portion 72 of the signal terminal 70. The crimping portions 85*b* are rotated so as to sandwich the central conductor 3*a* of the coaxial cable 3 disposed on top of the conductor connection portion 72 of the signal terminal 70 positioned in the recess 86. Thus, the central conductor 3*a* can be fixed with respect to the conductor connection portion 72. The front-side body 84 disposed to be adjacent to the rear-side body 85 includes a surface 84*a* facing surfaces 85*d* on the front side of the crimping portions 85*b*. The front-side body 84 assists the rotation of the crimping portions 85*b*, and also limits the movement of the crimping portions 85*b* in a predetermined range.

The central conductor 3*a* and the conductor connection portion 72 are fixed to each other by means of the rear-side body 85 and the front-side body 84. This means that if the coaxial cable 3 is pulled in the axial direction "α", not only the coaxial cable 3 but also the signal terminal 70 is subjected to a force in the axial direction "α". However, the wide portion 73 and the conductor connection portion 72 of the signal terminal 70 have their widths increased in the width direction "β" orthogonal to the axial direction "α". Accordingly, the signal terminal 70 can provide sufficient resistive force with respect to the force.

The shell 60 is formed by punching and bending a single sheet of metal plate. The housing 80 is disposed on a surface 66*a* of a planar substrate 66 of the shell 60, the surface 66*a* being positioned in a portion to be mated with the counterpart connector 2. The housing 80 is disposed in such position relationship with respect to the shell 60, whereby the height of the coaxial cable connector 6 can be decreased.

The shell 60 includes a substantially annular mating portion 61 on the distal end side thereof. The substantially annular mating portion 61 is bent toward the substrate 66, and is loosely fitted with respect to the outer periphery of the substantially cylindrical portion 82 of the housing 80. The mating portion 61, when the counterpart connector 2 is connected with the coaxial cable connector 6, is mated with the mating shell 20 of the counterpart connector 2. The mating portion 61 only needs to be configured to be mated with the mating shell 20 of the counterpart connector 2. The mating portion 61 does not directly influence the signal characteristics. Accordingly, the mating portion 61 may not be perfectly circular. Thus, the window 83*a* in the neck portion 83 of the housing 80 may be positioned in a cut-out 67 provided in the mating portion 61. By disposing the window 83*a* using the cut-out 67, it becomes possible to position the wide portion 73 in a position properly spaced apart from both the terminal contact portion 71 and the conductor connection portion 72 of the signal terminal 70, without increasing the size of the coaxial cable connector 6 in the axial direction "α".

The shell 60 may include clamping pieces 62 at the central portion thereof for clamping the crimping portions 85*b* of the housing 80. The crimping portions 85*b* are rotated about the folding portion 85*c*, as a center, toward the bottom portion 85*a*. By clamping the clamping pieces 62, the crimping portions 85*b* are fixed onto the bottom portion 85*a* due to the action of the clamping pieces 62, with the outer portion of the crimping portions 85*b* covered with the clamping pieces 62. To the rear end side of the clamping pieces 62, there are further provided, in this order, an outer conductor barrel 63 and an outer coating barrel 64. The outer conductor barrel 63 clamps the outer conductor 3*c* of the coaxial cable 3. On the rear end side of the outer conductor barrel 63, the outer coating barrel 64 clamps the outer coating 3*d*. The outer conductor barrel 63 may have, on the side facing the outer conductor 3*c*, ribs 63*a* for clamping the outer conductor 3*c*.

While a preferable embodiment has been described, it should be understood that the coaxial cable connector that has been described merely represent an article in accordance with the present embodiment. It will be readily appreciated by those skilled in the art that the preferable embodiment may be modified or changed into different embodiments in light of the foregoing teachings. For example, the terminal may not necessarily be provided in the axial direction. The terminal may be bent at right angles. The coaxial cable connector may not be configured in the axial direction. Accordingly, exemplary embodiments and alternative embodiments may be implemented without departing from the spirit of the articles that are set forth in the attached claims.

The coaxial cable connector of the present disclosure may include the following first to seventh coaxial cable connectors.

The first coaxial cable connector is a coaxial cable connector to be connected to one end of a coaxial cable, the coaxial cable connector including a signal terminal, a housing integrally molded with the signal terminal, and a shell attached to the housing, wherein the signal terminal includes a terminal contact portion for contacting a mating signal terminal of a counterpart connector, a conductor connection portion for connection with a central conductor of the coaxial cable, and a wide portion disposed between the terminal contact portion and the conductor connection portion, the wide portion being formed wider, in a width direction orthogonal to an axial direction of the coaxial cable, than at least parts of a first link portion linking the conductor connection portion and the wide portion and a second link portion linking the terminal contact portion and the wide portion, the parts being adjacent to the wide portion in the axial direction of the coaxial cable, wherein the housing is disposed on one surface of the shell on a side for mating with the counterpart connector, and includes a window for enabling external access to the wide portion between a mount portion in which the terminal contact portion is mounted and a fixing portion for fixing the central conductor of the coaxial cable with respect to the conductor connection portion.

The second coaxial cable connector is the first coaxial cable connector wherein the wide portion and the window are aligned in a direction for mating with the counterpart connector.

The third cable connector is the first or second coaxial cable connector wherein the signal terminal extends in the axial direction.

The fourth cable connector is any one of the first to third coaxial cable connectors, wherein the conductor connection portion is formed wider than the second link portion in the width direction.

The fifth cable connector is any one of the first to fourth coaxial cable connectors, wherein a part of the mount portion is formed as a substantially cylindrical portion, and at least a part of the substantially cylindrical portion, when mated with the counterpart connector, is internally fitted in a recess provided in a mating housing of the counterpart connector.

The sixth cable connector is the fifth coaxial cable connector wherein the window is provided in a central portion of the housing which is disposed between the substantially cylindrical portion and the fixing portion.

The seventh cable connector is the fifth or sixth coaxial cable connector wherein the shell includes a substantially annular mating portion which is loosely fitted with respect to an outer periphery of the substantially cylindrical portion, and the window is positioned in a cut-out provided in the substantially annular mating portion.

A coaxial connector device of the present disclosure may include any one of the first to seventh coaxial cable connectors and the counterpart connector.

What is claimed is:

1. A coaxial cable connector comprising:

a signal terminal;

a housing integrally formed with the signal terminal; and a shell attached to the housing, wherein the signal terminal includes a terminal contact portion for contacting a mating signal terminal of a counterpart connector, a conductor connection portion for connection with a central conductor of a coaxial cable, a wide portion disposed between the terminal contact portion and the conductor connection portion, a first link portion linking the conductor connection portion and the wide portion, and a second link portion linking the terminal contact portion and the wide portion, wherein the wide portion has a width, in a width direction orthogonal to an axial direction of the coaxial cable, greater than a width of at least parts of the first link portion and the second link portion which are adjacent to the wide portion in the axial direction of the coaxial cable, and the housing is disposed on a surface of the shell which is positioned in a portion for mating with the counterpart connector, and includes a mount portion in which the terminal contact portion is mounted, a fixing portion for fixing the central conductor of the coaxial cable with respect to the conductor connection portion, and a window disposed between the mount portion and the fixing portion to enable external access to the wide portion.

2. The coaxial cable connector according to claim 1, wherein the wide portion and the window are aligned in a direction for mating with the counterpart connector.

3. The coaxial cable connector according to claim 1, wherein the signal terminal extends in the axial direction.

4. The coaxial cable connector according to claim 1, wherein the conductor connection portion has a width greater than a width of the second link portion in the width direction.

5. The coaxial cable connector according to claim 1, wherein the mount portion includes a part which is formed as a substantially cylindrical portion; and the substantially cylindrical portion includes at least a part which, when mated with the counterpart connector, is internally fitted in a recess provided in a mating housing of the counterpart connector.

6. The coaxial cable connector according to claim 5, wherein the window is disposed in a central portion of the housing which is disposed between the substantially cylindrical portion and the fixing portion.

7. The coaxial cable connector according to claim 5, wherein the shell includes a substantially annular mating portion loosely fitted with respect to an outer periphery of the substantially cylindrical portion; and the window is positioned in a cut-out provided in the substantially annular mating portion.

8. A coaxial connector device comprising:

the coaxial cable connector according to claim 1; and the counterpart connector.

* * * * *